United States Patent [19]

Merson

[11] 3,968,603

[45] July 13, 1976

[54] PANEL FOR PREFABRICATED METAL BUILDINGS

[76] Inventor: Karol J. Merson, 1307 Crossfield Bend, Mississagua, Canada

[22] Filed: Mar. 25, 1974

[21] Appl. No.: 454,149

[30] Foreign Application Priority Data

May 15, 1973 Canada ..... 171581

[52] U.S. Cl. ..... 52/86; 52/574; 52/588; 52/630

[51] Int. Cl.[2] ..... E04B 1/32; E04C 2/32

[58] Field of Search ..... 52/579, 588, 630, 86, 52/574, 245; 61/45 R, 60, 61, 62

[56] References Cited

UNITED STATES PATENTS

| | | | |
|---|---|---|---|
| 1,042,571 | 10/1912 | Larssen | 61/60 |
| 1,784,777 | 12/1930 | Beaujean | 61/60 |
| 2,596,934 | 5/1952 | Langbein | 52/574 |
| 2,752,643 | 7/1956 | Helt | 52/574 |
| 2,991,855 | 7/1961 | Buell | 52/588 |
| 3,059,734 | 10/1962 | Tripp | 52/630 |
| 3,097,494 | 7/1963 | Chapron | 61/45 R |
| 3,199,260 | 8/1965 | Blok | 52/574 |
| 3,234,697 | 2/1966 | Toti | 52/588 |
| 3,304,680 | 2/1967 | Birdwell | 52/588 |
| 3,308,596 | 3/1967 | Cooper | 52/630 |
| 3,417,519 | 12/1968 | Hitter | 52/588 |
| 3,820,295 | 6/1974 | Folley | 52/630 |
| D164,990 | 10/1951 | Haman | D54/2 A |

FOREIGN PATENTS OR APPLICATIONS

| | | | |
|---|---|---|---|
| 817,781 | 5/1937 | France | 52/588 |
| 641,946 | 8/1950 | United Kingdom | 52/588 |

*Primary Examiner*—Ernest R. Purser
*Assistant Examiner*—William Randolph
*Attorney, Agent, or Firm*—Fetherstonhaugh & Co.

[57] ABSTRACT

A panel for prefabricated metal buildings according to the present invention has a trough section which is deeper than that which can normally be obtained by a cold roll forming operation. The deep trough section is achieved by using a center web joint to connect a plurality of oppositely disposed U-shaped sections to one another to form the panel. The sections are connected by flanges which project outwardly from the side walls of the sections and the connection may be achieved by a crimping operation or by means of a plurality of clamps.

3 Claims, 9 Drawing Figures

FIG. 5
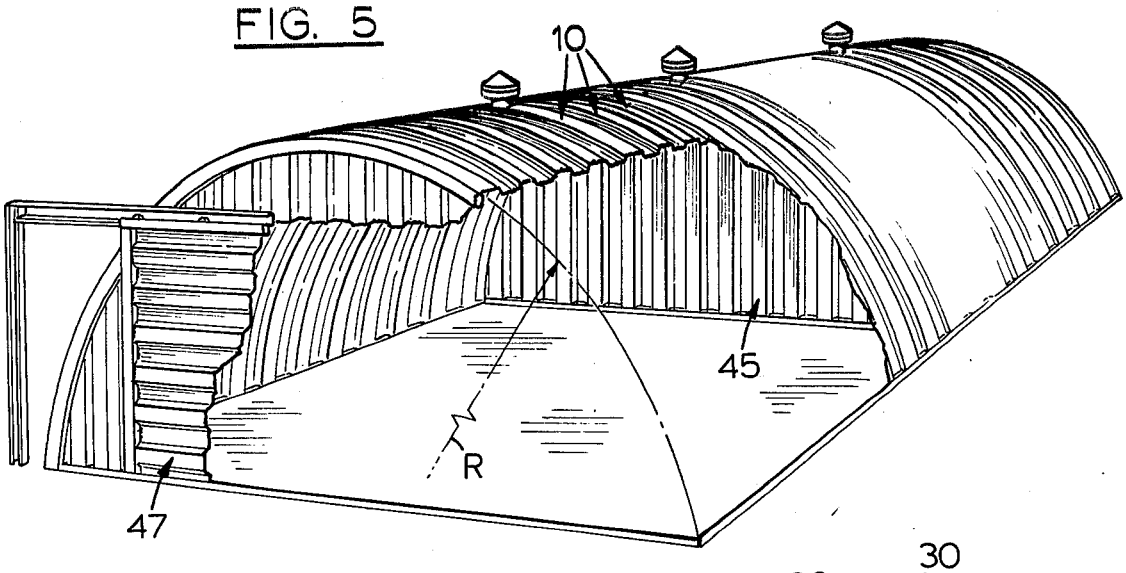
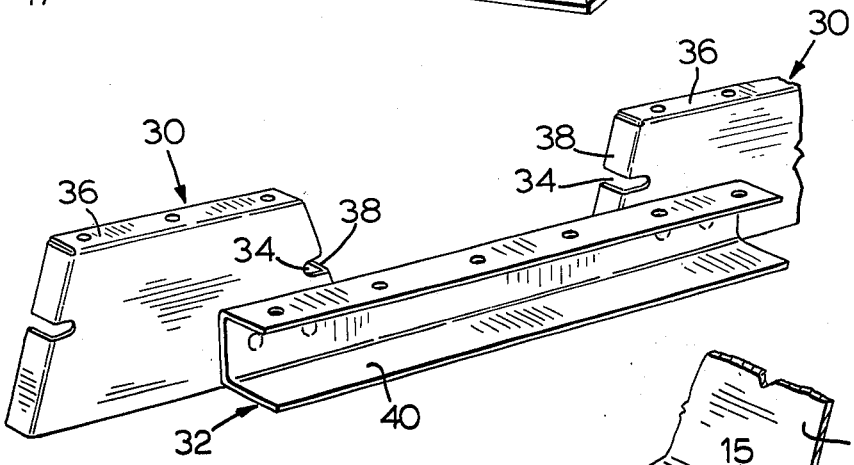
FIG. 4
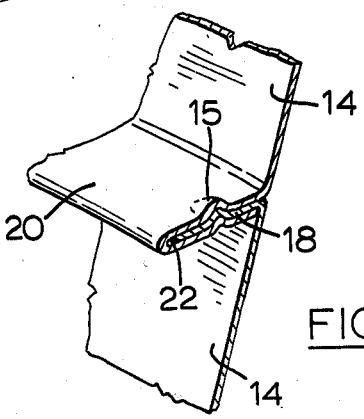
FIG. 3
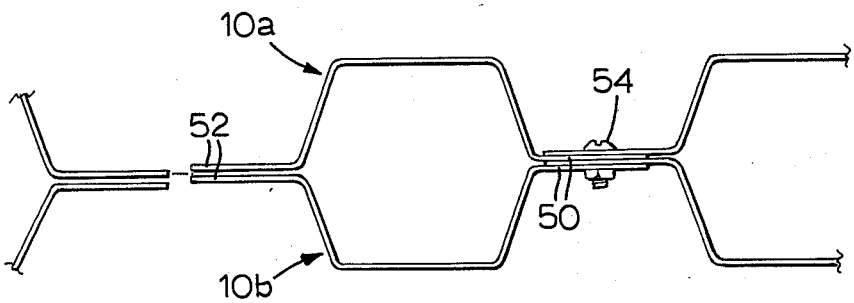
FIG. 6

PANEL FOR PREFABRICATED METAL BUILDINGS

FIELD OF INVENTION

This invention relates to prefabricated steel buildings. In particular, this invention relates to the structure of the members for use in the fabrication of arch-shaped buildings such as farm barns and the like.

PRIOR ART

Prefabricated buildings such as barns are well-known and the practice is to form these buildings from arch-shaped lengths of rolled steel which are formed into identical trough-shaped sections. The normal trough-shaped section is substantially U-shaped with the legs of the U being outwardly inclined and having laterally projecting flanges at the outer edge thereof. These U-shaped sections are connected to one another by means of the laterally extending flanges so that the flanges form the crests of the assembled panels and the bottom wall of the U-shaped section forms the valley of the assembled panel. The total depth of the assembled panel is substantially equal to the depth of one section. The greater the depth of the section of the panel, the greater the resisting moment and, therefore, the greater the load which can be carried by the assembled structure or the greater the span which can be bridged by the structure. In practice, it is normal to make sections measuring from 5 to 10 inches in depth.

In order to achieve a radius of curvature of about twenty-five feet in a trough section measuring from 5 to 10 inches, it is necessary to form a plurality of transversely extending cross corrugations in the base of the trough section. In the formation of the cross corrugations which are formed by a crimping operation, the trough shaped section is formed with a longitudinal curvature. The crimping operation is a costly and time-consuming operation and adds considerably to the cost of production of the panels. While conventional cold roll forming operation may be employed to achieve the required trough shaped corrugations, it is not possible to bend the deep sections to the required arc of curvature. The crimping operation effectively shortens the bottom wall of the panel and thereby forms the required arc of curvature.

The cross corrugations which are formed on each panel as a result of the crimping operation do not add significantly to the resisting moment of the section and, in fact, the corrugations weaken the section in tension or compression. Under the influence of forces acting lateral of the corrugations, additional bending moments are created which must be added to the normal stresses which are applied in use and, therefore, the load carrying capacity is reduced.

The width of the bottom wall of a conventional corrugated section must be limited so as to prevent buckling. The cross corrugations increase the resistance of the bottom wall to buckling, however, in view of the fact that the corrugations are not of any great depth, the increased strength is not great. The ratio of the thickness of material to flat width span determines the buckling efficiency of the section in compression and it is necessary to ensure that the flat width to thickness ratio is not excessive.

The present invention eliminates the crimping step from the method of manufacturing of the sections while providing a section of a depth which is at least as great as the depth which is achieved in the conventional crimping operation. This improvement is obtained by forming the sections in a cold rolling operation to a depth permitted by a cold rolling operation and forming the assembly by a center web joint so that one U-shaped section is connected to another U-shaped section substantially centrally of the depth of the assembled panel. The center web joint construction has the advantage of providing an assembled panel which has a depth at least equal to the depth of the corrugated sections, while permitting each section to be formed in a conventional cold rolling operation. The combined depth of the troughs in the assembled panel may equal up to twice the depth of the trough in any one section. The absence of transverse corrugations in the bottom wall of each panel permits longitudinal corrugations to be formed in the bottom wall so as to further increase the moment of inertia of the section and thereby increase the strength of the assembly. The longitudinal corrugations serve to retain the required ratio of thickness of material to flat width so as to prevent buckling of the bottom walls or panel in use. The fact that the sections can be formed in a cold rolling operation considerably reduces the cost of manufacture of each panel. The fact that the combined depth of the panels when connected at the center of the web joining the panels may be as great as the depth achieved by the corrugating operation, ensures that there is no loss in strength. In fact, the absence of the transverse corrugations combined with the ability to form longitudinal reinforcing ribs in each section increases the strength of the panel.

SUMMARY OF INVENTION

According to an embodiment of the present invention, an arch-shaped roof structure comprises a plurality of generally U-shaped sections which are connected to one another centrally of the webs which join each section to form a panel.

According to a further embodiment of the invention, the U-shaped sections are formed by a cold rolling operation.

Accordng to a still further embodiment of the invention, the bottom wall of each trough-shaped section is formed with a plurality of longitudinally extending ribs. A flange is formed at the free edge of each side wall and the flange on one side wall projecting outwardly of the section and the flange on the other side wall projecting inwardly of the section, whereby flanges of adjacently disposed panels may be connected to one another to secure the sections in a position in which the U-shaped form of adjacent sections opening in opposite directions.

PREFERRED EMBODIMENTS

The invention will be more clearly understood with reference to the drawings wherein FIG. 1 illustrates a pictorial view of a section of a panel according to an embodiment of the present invention;

FIG. 3 is an enlarged detailed cross-sectional view illustrating the manner in which the sections are connected;

FIG. 4 is a partial pictorial view of a transverse reinforcing web structure;

Figure 7:
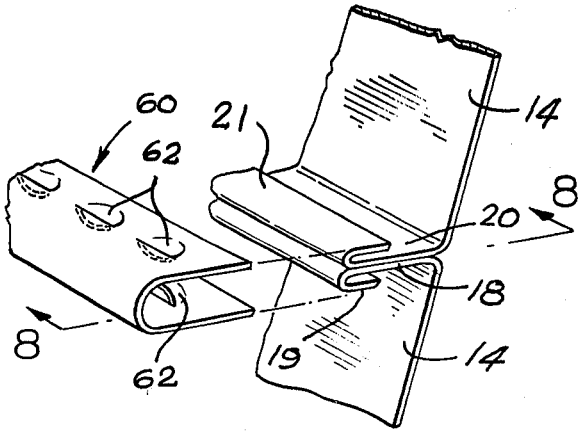
Figure 8:
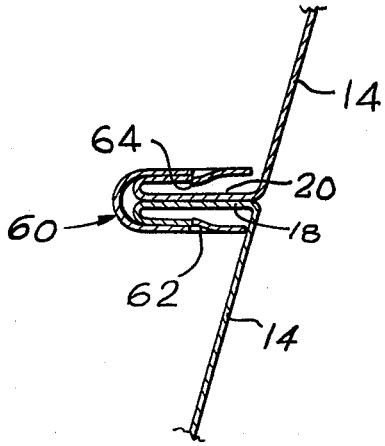

FIG. 5 of the drawings is a partially sectioned pictorial view of an arch shaped building constructed in accordance with an embodiment of the present invention;

FIG. 6 is a sectional view of an alternative form of a center web joined panel;

FIG. 7 is an exploded pictorial view illustrating an alternative form of connector for connecting the flanges of the sections;

FIG. 8 is a cross-sectional view of the assembled fastener of FIG. 7; and

Figure 9:
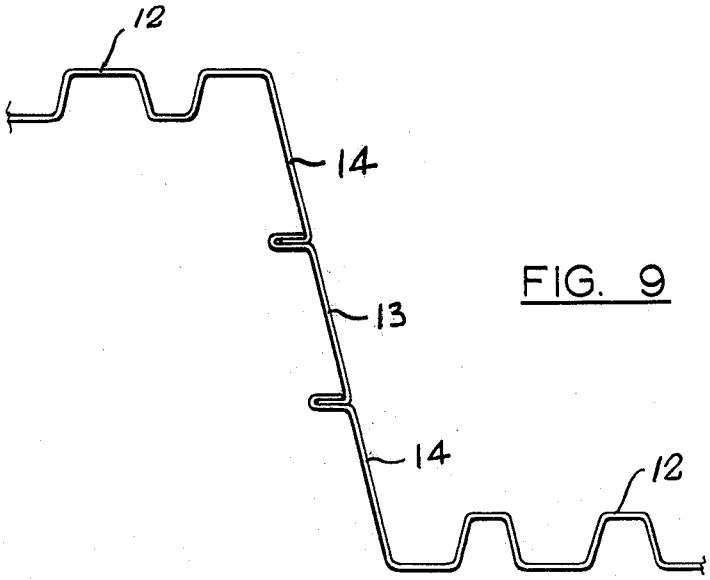

FIG. 9 is an end view of a still further cross-section in which the depth of the section is increased by the provision of a spacer member.

Figure 1:
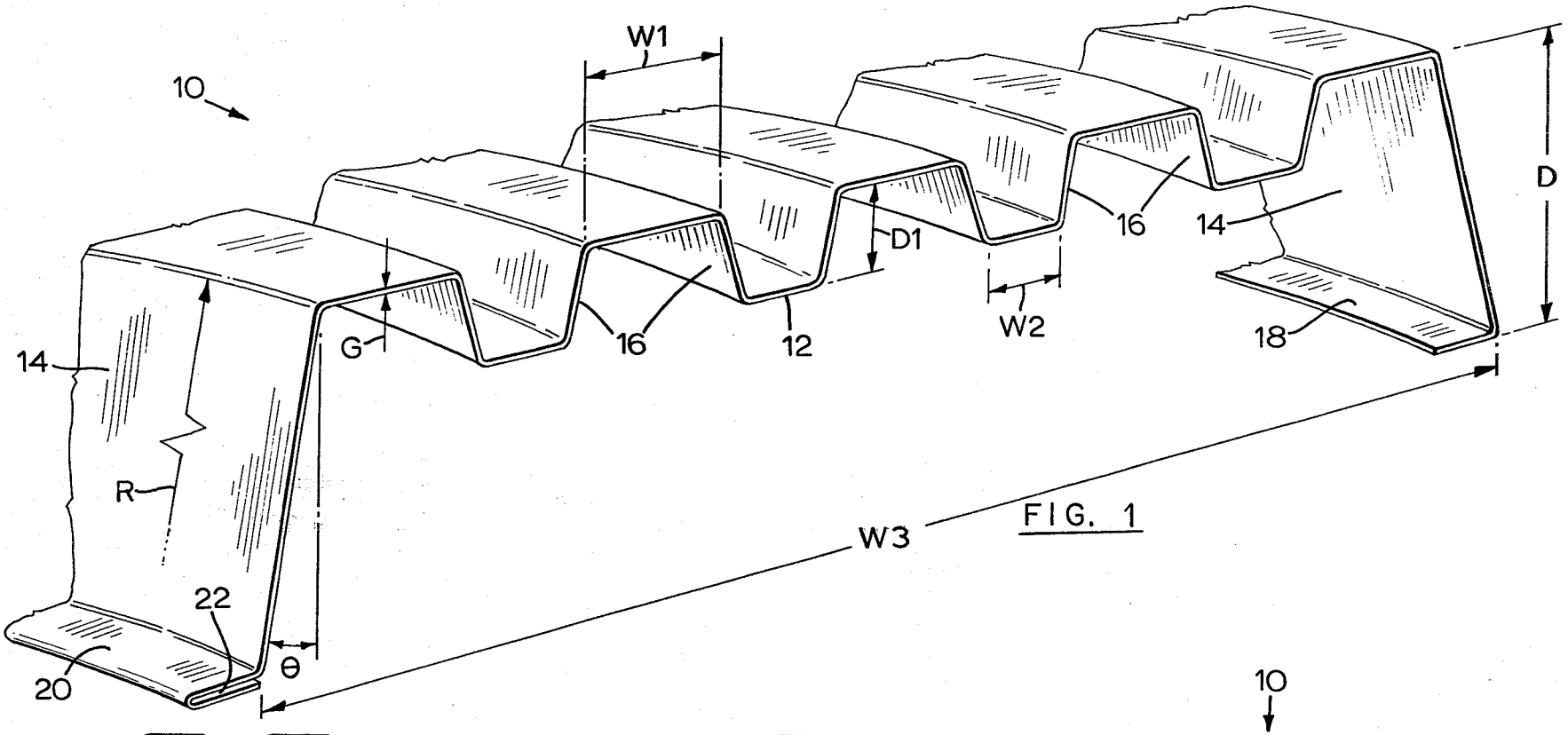

With reference to FIG. 1 of the drawings, the reference numeral 10 refers generally to a section according to an embodiment of the present invention. The section consists of a bottom wall 12 and a pair of oppositely disposed side walls 14 which are formed to a generally U-shaped configuration. The bottom wall 12 is formed with a plurality of longitudinally extending ribs 16 which are also of a generally U-shaped configuration. The free edge of one side wall 14 has a flange or lip 18 projecting inwardly of the U-shaped section while the free edge of the other side wall 14 has a flange or lip 20 extending outwardly of the section and folded upon itself to provide a narrow slot 22 adapted to receive a lip 18 in a close fitting relationship.

The section 10 is preferably made from rolled sheet steel, aluminum or the like. A flat sheet of steel is cold formed to the required cross-section such as that illustrated in FIG. 1, of the drawings and bending of the section to the required radius of curvature is achieved simultaneously with the cold roll forming operation. It will be noted that the depth D of the section is considerably less than the width W of the bottom wall. It is not necessary to achieve the total depth D3 of the assembled panel by a single rolling operation so that the depth D may be within the limits which a section of a specified gauge thickness G may be rolled to provide the required generally U-shaped configuration. This is in contrast to the practice in the formation of the panels in the crimping operation wherein the maximum depth of the assembly is substantially equal to the depth of the individual channel-shaped sections. It will be noted that while the section of the present invention is described as being a substantially U-shaped section, the side walls 14 are outwardly inclined at an angle $\theta$, generally in the range of 0° to 45° and preferably about 33° with respect to a plane normal to the plane of the bottom wall 12.

The ribs 16 which are formed in the bottom wall 12 have a base width W1 which may be greater than the crest width W2 but which is substantially less than the total width W of the bottom wall. The widths W1 and W2 are proportioned so that the ration of thickness of material to flat width is sufficient to ensure that buckling will not occur under the loads which the section is designed to support.

The strength of the section is related to the gauge G of the material and the proportions of the dimensions W, W1, W2, W3, D and D1. A typical panel may have the following sectional dimensions:

W — 14 inches
W1 — 1.65 inches
W2 — 0.9375 inches
D — 3.75 inches
D1 — 1 inch Table 1 below provides particulars of the characteristics of a sample section of the type described above with approximate estimates of the span of the arch for a specific snow load.

CALCULATED PROPERTIES PER FOOT OF WIDTH OF ERECTED ASSEMBLY

| GAUGE | | 22 | 20 | 18 | 16 |
|---|---|---|---|---|---|
| Effective Area | $IN^2$ | .64 | .77 | 1.02 | 1.28 |
| Section Modulus | $IN^3$ | 1.60 | 1.92 | 2.56 | 3.20 |
| Moment of Inertia | $IN^4$ | 6.00 | 7.2 | 9.60 | 12.00 |
| Radius of Giration | IN | 3.00 | 2.98 | 2.96 | 2.94 |
| Weight per sq. ft. | LBS. | 2.18 | 2.62 | 3.50 | 4.36 |
| Building size 40 PSF Snow | | 50"×18" | 60'×20' | 70'×24.5' | 80'×27' |
| Building size 60 PSF Snow | | 40'×15' | | 50'×18' | 60'×20' |
| Building size 30 PSF Snow | | 60'×20' | 70'×24.5' | 80'×27' | 90'×28' |

The amount of extension of the bottom wall of the section required in order to achieve the required radius of curvature cannot be achieved in a section having the depth required without damaging the bottom wall in the formation of the curvature. As previously indicated, this is the reason why the structures of the prior art are formed to the required radius of curvature by means of a crimping operation which reduces the width of the base of the section. The fact that the structures of the prior art are formed by crimping the bottom wall to achieve the required configuration prevents these structures from being connected to one another in a central web connection as in the case of the present application. The crimping of the bottom wall reduces the length of the bottom wall and permits the bottom wall to form the smaller radius of curvature of the section. If an attempt were made to connect the sections in the manner of the present invention, it would be necessary to stretch the bottom wall of one section while crimping the bottom wall of the other section. Obviously if the bottom wall is outwardly disposed it must be of a greater length than the inner edge of the side walls.

As a result of the fact that the bottom wall of the known channel section is crimped, the weight per foot length of the section and the amount of material required to obtain a foot length is greater than that of the section of the present invention even when the resisting moments of the sections are substantially identical. In fact, the weight per foot length of a section of the present invention having a resisting moment which is greater than the section of the prior art may be considerably less than the weight per foot length of the crimped length of material. This reduces the amount of material used and thereby reduces the cost of the materials from which the sections are fabricated.

Figure 2:
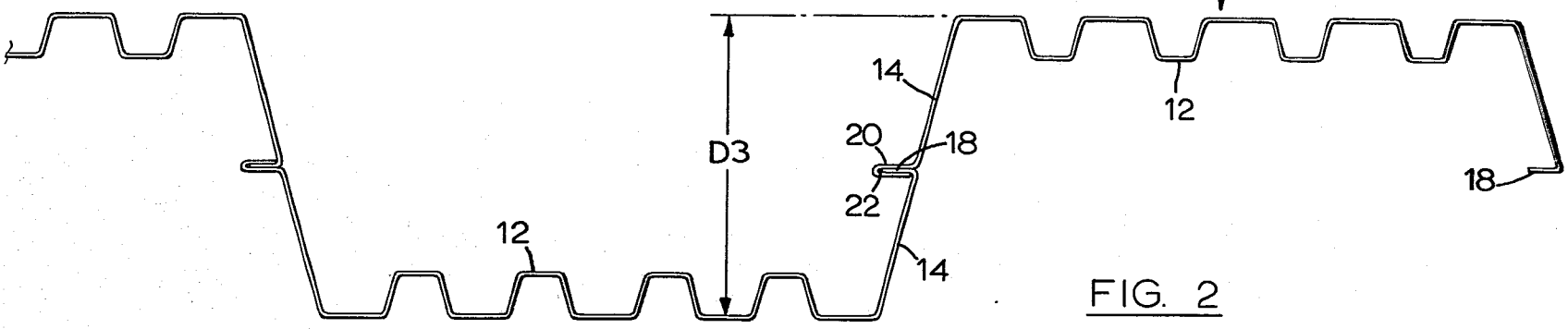
FIG. 2 is a cross-section illustrating the manner in which the sections are assembled to form a panel.

As previously indicated, the sections may be assembled as shown in FIG. 2 of the drawings such that a flange 18 of one panel is located within a slot 22 formed in the flange 20 of an adjacent panel and the U-shaped section of adjacent panels open in opposite directions. This construction may be such that the assembled wall unit is connected along a plane which is disposed substantially centrally of the depth of the side walls or webs. It will be noted that while the sections 10 are identical to one another in section, the radius of curvature of one section will be oppositely disposed with respect to the radius of curvature of the adjacent panel so as to achieve a pair of sections interconnectible as shown in FIG. 2 of the drawings.

The side walls 14 are connected as shown in FIG. 3 of the drawings wherein the flange or lip 18 of one side wall is located within the slot 22 formed in the flange or lip 20 of the other side wall and the flanges are deformed by a conventional crimping operation to form a plurality of buttons 15 at spaced intervals along the length of the flange. One advantage of this construction over the prior art constructions is that both sides of the flange are exposed along the length of the flange so that a crimping tool may be used to form the connection. In the conventional structures, it is necessary to bolt the flanges together in view of the fact that it is not possible to gain access to both sides of the flange for the purpose of crimping the flange with a conventional crimping tool. It will, however, be apparent that flanges of the present invention may also be bolted together. Again, the fact that both sides of the flanges are exposed ensures that a conventional nut and bolt assembly may be employed and that access is available to both sides for tightening the nut with respect to the bolt.

The assembled panels may be transversely reinforced by means of a reinforcing structure as illustrated in FIG. 4 of the drawings. The reinforcing structure comprises a plurality of plates 30 connected by bridge plates 32. The plates 30 have a shape substantially conforming to the shape of the U-shaped sections and notches 34 are provided at each edge to provide a clearance for inwardly projecting connecting flanges. Each plate 30 has flanges 36 and 38 projecting from the upper and side edges thereof. Flanges 36 and 38 are secured to walls 12 and 14 of the wall panel assembly and they are connected by bridge piece 32 which has a stiffening flange 40 projecting at the lower edge thereof. Transverse reinforcing members of the type illustrated in FIG. 4 of the drawings may be located at a plurality of longitudinally spaced intervals along the length of the assembled panel.

For the purposes of analysis the assembled panel may be considered as being similar to a series of Z-shaped beams with the two side walls 14 being connected to one another to form the web and the bottom walls 12 forming the flanges of the Z section. This section may be defined as a center web joined Z-shaped beam. A further embodiment of the invention is illustrated in FIG. 9 of the drawings wherein the depth of the trough section is increased by the introduction of the spacer plate 13 which extends between the side walls 14. The spacer plate may be used to achieve trough depth greater than that which can be achieved in a cold roll forming operation.

A further embodiment of the present invention is illustrated in FIGS. 7 and 8 of the drawings. In the embodiment illustrated in FIGS. 2 and 3 of the drawings, the flanges 18 and 20 have been secured by a crimping tool. In the embodiment illustrated in FIGS. 7 and 8 of the drawings, the flanges 18 and 20 are folded upon themselves to form lugs 19 and 21 directed towards their adjacent side wall. A plurality of clamps 60 are formed from sheet metal and serve to secure the flanges to one another. Each flange 60 is substantially U-shaped and has a pair of lugs 62 projecting inwardly from each arm thereof. Each of the lugs 62 has a transverse end face 64. As shown in FIG. 8 of the drawings, when the clamps are in use the lugs 64 engage the inner edges of the lips 21 and serve to secure the flanges 18 and 20 with respect to one another and thereby secure the sections 10 in an assembled panel.

Wall assemblies constructed in accordance with the present invention may be employed as arch-shaped roof structures of the type commonly known as a "Quonset" building which may be readily assembled in its required location. A typical building of this type is illustrated in FIG. 5 of the drawings wherein it will be seen that a plurality of panels are connected to one another to form an arch-shaped roof structure. It will also be noted that the end walls 45 and the sliding door 47 may be fabricated from a plurality of panels of the type described above.

Various modifications of the present invention will be apparent to those skilled in the art without departing from the scope of the invention. For example, the proportions and form of the bottom wall longitudinal reinforcing rims may be modified as required in use. FIG. 6 of the drawings illustrates a further embodiment of the invention wherein panels **10*a* and 10*b* are formed with flanges 50 and 52 which are connected to adjacent flanges of an adjacent panel assembly in the configuration shown in FIG. 7 by means of a suitable fastener 54.** This structure provides an alternative construction which employs a center web joint.

These and other modifications of the present invention will be apparent to those skilled in the art.

I claim:

1. In a prefabricated sheet metal building, a composite wall panel comprising:

multiple first and second complementary sheet metal members alternately interconnected in series, each member being longitudinally elongated and longitudinally curved to conform with a common arc of curvature of the wall panel;

said first sheet metal members each having a base wall curving with said common arc but located radially inside the arc and having longitudinal reinforcing ribs comprising radially extending corrugations, and each first member having a pair of opposed side walls forming with said base wall a U-shaped cross-sectional configuration, said side walls projecting radially outwardly beyond said corrugations and terminating in longitudinal locking flanges respectively located along said common arc;

said second sheet metal members each having a base wall curving with said common arc but located radially outside the arc and having longitudinal reinforcing ribs comprising radially extending corrugations, and each second member having a pair of opposed side walls forming with said base wall a U-shaped cross-sectional configuration, said side walls projecting radially inwardly beyond said corrugations and terminating in longitudinal locking flanges respectively located along said common arc; and the side walls of the first and second sheet metal members meeting with their respective locking flanges interconnected at said common arc and with their side walls aligned so that they occupy a common plane extending from the locking flanges to the respective base walls of the members, the locking flanges of said members including flange portions following the curvature of said common arc and disposed substantially at right angles to said common plane so that when the members are interconnected the flange portions will unite in radially abutting mutual relationship.

2. In a sheet metal building wall as set forth in claim 1, one of the flange portions at each interconnection being folded upon itself to form a longitudinally extending slot for receiving the other interconnecting flange portion.

3. In a sheet metal building wall as set forth in claim 2, wherein for a given metal and gauge and for a given arc of curvature there is a maximum possible depth to which said U-shaped cross-section can be formed, said side walls projecting beyond said base wall by a radial distance greater than 50 percent of said maximum possible depth.

* * * * *